US011044959B2

(12) United States Patent
Genender et al.

(10) Patent No.: US 11,044,959 B2
(45) Date of Patent: Jun. 29, 2021

(54) SURGICAL CAP AND METHOD

(71) Applicant: Medline Industries, Inc., Mundelein, IL (US)

(72) Inventors: Alan Genender, Northbrook, IL (US); Hannah Zundel, Chicago, IL (US)

(73) Assignee: Medline Industries, Inc., Northfield, IL (US)

( * ) Notice: Subject to any disclaimer, the term of this patent is extended or adjusted under 35 U.S.C. 154(b) by 345 days.

(21) Appl. No.: 15/204,742

(22) Filed: Jul. 7, 2016

(65) Prior Publication Data

US 2018/0007989 A1 Jan. 11, 2018

(51) Int. Cl.

| | |
|---|---|
| ***A42B 1/012*** | (2021.01) |
| ***A42B 1/22*** | (2006.01) |
| ***B29C 65/56*** | (2006.01) |
| *B29L 31/00* | (2006.01) |

(52) U.S. Cl.

CPC ..... *A42B 1/012* (2021.01); *A42B 1/22* (2013.01); *B29C 65/565* (2013.01); *B29L 2031/7546* (2013.01)

(58) Field of Classification Search

CPC ..... A42B 1/043; A42B 1/201; A42B 1/20; A42B 1/208; A42B 1/206; A42B 1/006; A42B 1/069; A42B 1/12; A42B 1/18; A42B 1/241; A42B 1/012; A42B 1/22

USPC ..... 2/171.6, 171.03, 209.11, 195.7, 200.3

See application file for complete search history.

(56) References Cited

U.S. PATENT DOCUMENTS

| | | | | |
|---|---|---|---|---|
| 1,408,373 A * | 2/1922 | Lustgarten | ..... | A41B 9/08 2/407 |
| 1,526,322 A * | 2/1925 | Dehne | ..... | A42B 1/18 2/46 |
| 1,836,141 A * | 12/1931 | Wagenfeld | ..... | A42B 1/043 2/195.7 |
| 2,183,257 A | 12/1939 | Hardie | | |

(Continued)

FOREIGN PATENT DOCUMENTS

| | | |
|---|---|---|
| CN | 1373639 | 10/2002 |
| CN | 203505682 | 4/2014 |

(Continued)

OTHER PUBLICATIONS

Photograph of "Disposable Surgeon's Cap," Medline product #NON28626, currently available at http://www.medline.com/sku/item/MDPNON28626?skuIndex=P3S3&question=cap&flowType=search&indexCount=3, and publicly available at least prior to Apr. 15, 2016.

(Continued)

*Primary Examiner* — Sally Haden

(74) *Attorney, Agent, or Firm* — Fitch, Even, Tabin & Flannery LLP

(57) ABSTRACT

In accordance with one aspect of the present disclosure, a surgical cap is provided that includes a cover having a head-receiving cavity and a resilient member connected to the cover and extending about less than the entire head-receiving cavity. The cover includes a plurality of layers comprising at least one layer inward from the resilient member adapted to separate the resilient member from a head received in the head-receiving cavity and at least two outer layers outward from the resilient member to which the resilient member is secured. In accordance with another aspect, a method of fabricating a surgical cap is provided.

16 Claims, 10 Drawing Sheets

(56) References Cited

U.S. PATENT DOCUMENTS

| | | | | |
|---|---|---|---|---|
| 2,398,246 | A | 4/1946 | Rasmussen | |
| D162,763 | S | 4/1951 | Weissberger | |
| D164,752 | S | 10/1951 | Williams | |
| D164,753 | S | 10/1951 | Williams | |
| 2,665,427 | A | 1/1954 | Street | |
| D182,632 | S | 4/1958 | Turner | |
| D185,269 | S | 5/1959 | Emmet | |
| 3,009,159 | A | 11/1961 | Emmet | |
| D206,992 | S | 2/1967 | Skier | |
| D210,056 | S | 1/1968 | Hayes | |
| D228,830 | S | 10/1973 | Rutman | |
| D258,395 | S | 3/1981 | Lee | |
| 4,400,830 | A | 8/1983 | Gaitan | |
| 4,651,352 | A * | 3/1987 | Ranzer | A42B 1/043 2/200.3 |
| 5,008,961 | A | 4/1991 | Hubbard | |
| 5,218,723 | A | 6/1993 | McLaughlin | |
| 5,249,308 | A | 10/1993 | Blume | |
| 5,309,574 | A | 5/1994 | Balaban | |
| D473,365 | S | 4/2003 | Bias | |
| D479,020 | S | 8/2003 | Heinrich | |
| D517,284 | S | 3/2006 | Black | |
| D519,262 | S | 4/2006 | Davis | |
| D547,030 | S | 7/2007 | Marquardt | |
| 7,305,996 | B2 | 12/2007 | Kraft | |
| D584,000 | S | 12/2008 | Saluan | |
| D610,779 | S | 3/2010 | Rhodes | |
| D630,004 | S | 1/2011 | Martinez | |
| 8,061,368 | B2 | 11/2011 | Chudzik | |
| D658,853 | S | 5/2012 | Hart | |
| D704,894 | S | 5/2014 | Jennings | |
| D739,087 | S | 9/2015 | Jennings | |
| D743,673 | S | 11/2015 | Yoo | |
| D782,785 | S | 4/2017 | Diamond | |
| D787,163 | S | 5/2017 | Yates | |
| D794,916 | S | 8/2017 | Wright | |
| D795,537 | S | 8/2017 | Yates | |
| 2005/0144702 | A1 | 7/2005 | Whitney | |
| 2005/0160519 | A1 | 7/2005 | Cho | |
| 2006/0168709 | A1 * | 8/2006 | Rattay | A42B 1/201 2/183 |
| 2008/0222782 | A1 | 9/2008 | Stokes | |
| 2010/0083423 | A1 | 4/2010 | Erickson | |
| 2015/0150327 | A1 | 6/2015 | Scott | |
| 2016/0100648 | A1 | 4/2016 | De Jesu | |
| 2017/0188644 | A1 | 7/2017 | Foresta | |

FOREIGN PATENT DOCUMENTS

| | | |
|---|---|---|
| EM | 0034215440004 | 1/2017 |
| EM | 0034215440005 | 1/2017 |
| EM | 0034215440006 | 1/2017 |
| EM | 0035332070001 | 1/2017 |
| EM | 0035332070002 | 1/2017 |
| EM | 0035332070003 | 1/2017 |
| FR | 1586171 | 2/1970 |
| GB | 473457 | 10/1937 |
| GB | 1552692 | 9/1979 |
| WO | 0105259 | 1/2001 |

OTHER PUBLICATIONS

Photograph of Medline Product #NON61950, publicly available at least prior to Apr. 15, 2016.

Photograph of "Disposable Surgeon's Cap" , Medline product #NON28625, currently available at http://www.medline.com/product/Disposable-Surgeons-Caps/Surgeons-Caps/Z05-PF02529? question=cap&index=P3&indexCount=3# , and publicly available at least prior to Apr. 15, 2016.

Photograph of "Head Cover" , Medline product #NON61950, currently available at http://www.medline.com/product/Surgical-Caps/Protective-Head-Covers/Z05-PF144830?question=non61950&index=P1&indexCount=1, and publicly available at least prior to Apr. 15, 2016.

Extended European Search Report from European Patent Application No. 17180304.2 dated Nov. 6, 2017, 8 pages.

Chinese Office Action from Chinese Patent Application No. 201710541872.2 (English translation included) dated Nov. 28, 2019; 19 pages.

Medline Premium Surgical Caps, [on-line]; [article review posted to the Internet on Mar. 4, 2014]; [retrieved from the Internet on May 19, 2017]; URL: <https://www.healthproductsforyou.com/p-Medline-Premium-Surgical-Caps.html>. (5 pages).

* cited by examiner

SURGICAL CAP AND METHOD

FIELD

The present disclosure relates to protective clothing and, more particularly, to a surgical cap and method of fabricating a surgical cap.

BACKGROUND

Protective clothing, including surgical caps, are worn in surgical settings to limit contamination. Some traditional bouffant surgical caps have an elastic band extending completely around a lower end of the cap which can stretch to accommodate different size heads, hairstyles, etc. One of the problems associated with these traditional surgical caps is that they may leave a mark on the wearer's head and/or cause irritation to the wearer's skin.

Terms of orientation are for convenient reference to the drawings and are not intended to limit the orientation of the orientation of the surgical cap in use.

DETAILED DESCRIPTION

In general, a surgical cap is provided having a cover with a head-receiving cavity and a resilient member connected to the cover and extending about less than the entire head-receiving cavity. The surgical cap includes at least one and preferably a plurality of layers of the cover including at least one inner layer inward from the resilient member adapted to separate the resilient member from a head received in the head-receiving cavity and at least two outer layers outward from the resilient member to which the resilient member is secured. The at least one inner layer covers the resilient member and reduces irritation to the wearer's head. The resilient member may be secured to the at least two outer layers and the at least two layers provide support to the resilient member. Further, by utilizing at least two layers, the material used for the at least two layers may be thinner than might be required for a single layer cap.

Figure 1:
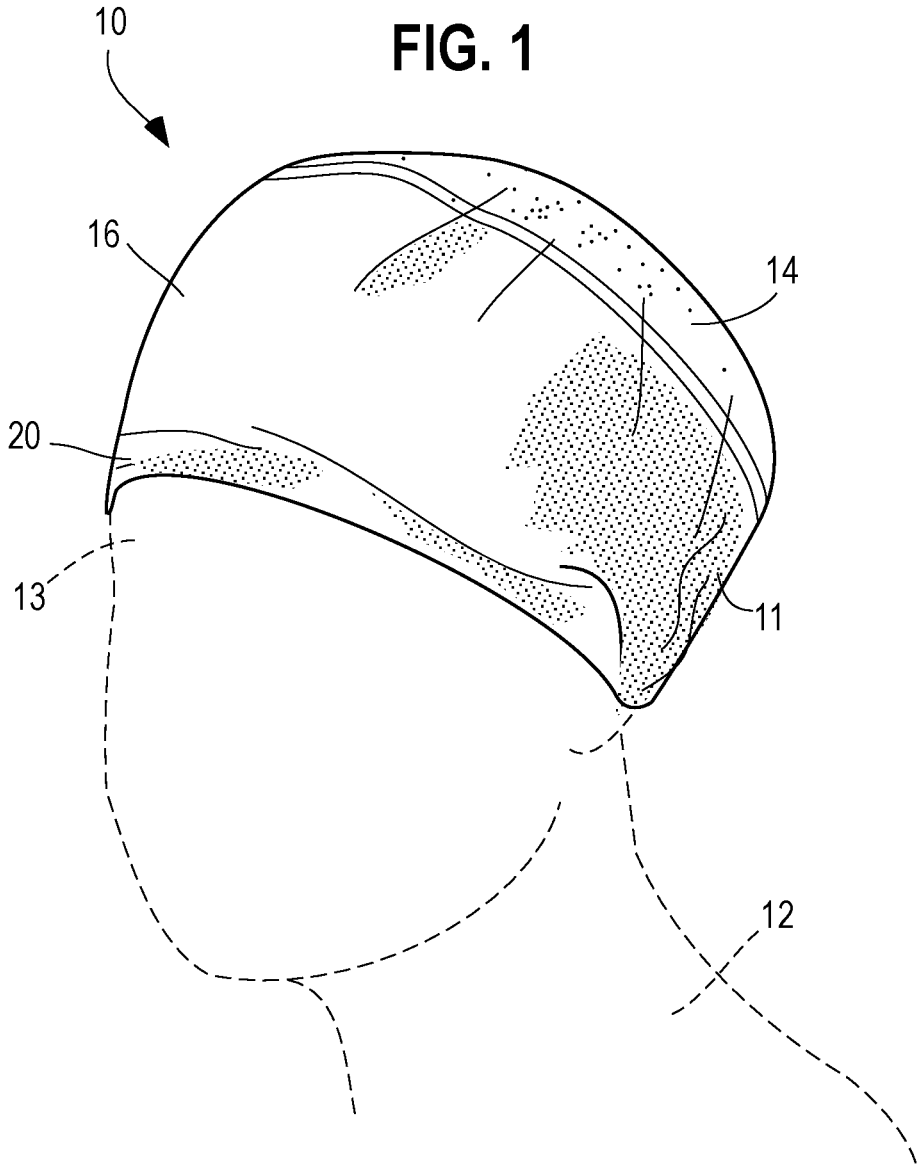
FIG. 1 is a front perspective view of a person wearing a surgical cap.
Figure 2:
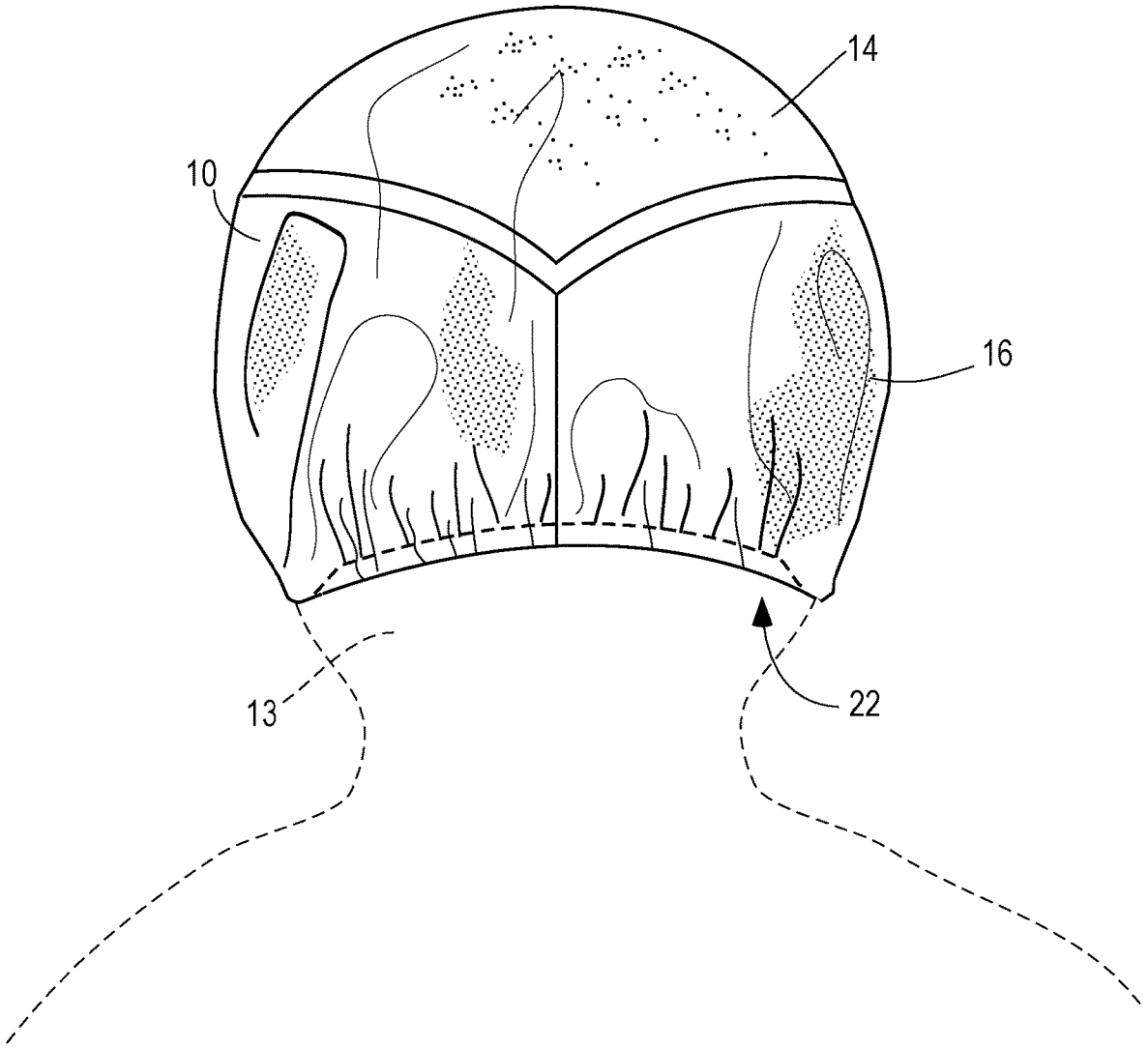
FIG. 2 is a rear elevational view of the person wearing the surgical cap of FIG. 1.

With reference to FIGS. 1 and 2, the surgical cap 10 has a cover 11 that covers the forehead, hair, ears, sideburns, and nape of the neck of a user 12. The cover 11 includes a top 14 made of the first material and a side wall 16 made of a second material. The first material may be selected to provide breathability while the second material may be selected to provide a stronger material for withstanding tearing during fabrication and wear of the surgical cap 10.

Figure 3:
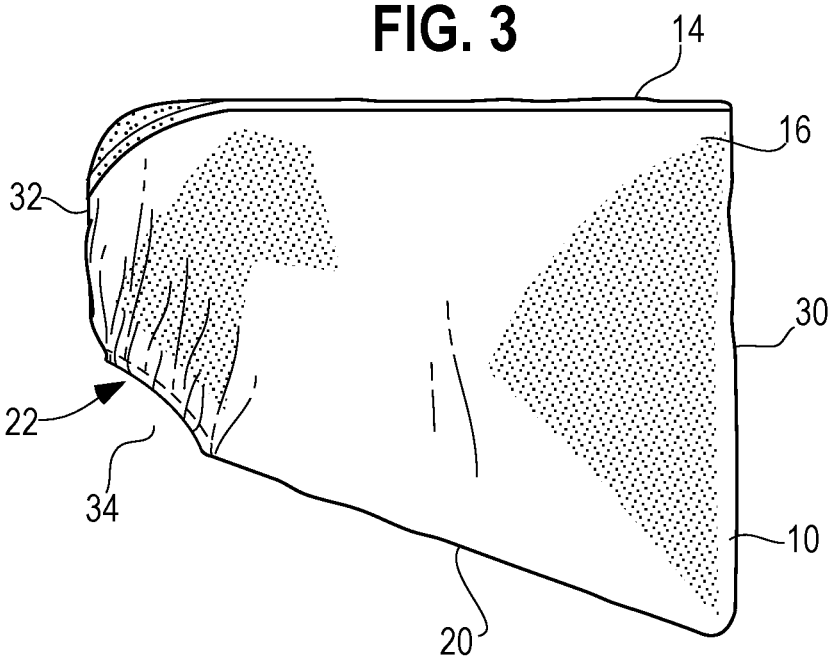
FIG. 3 is a side elevational view of the surgical cap of FIG. 1.
Figure 4:
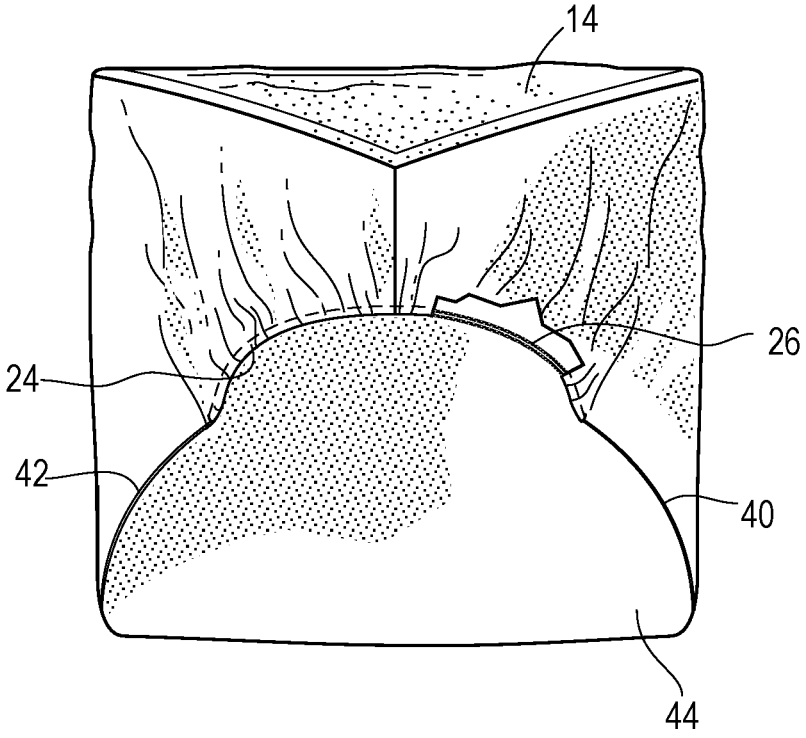
FIG. 4 is a rear elevational view of the surgical cap of FIG. 1 with a portion of the cap removed to show an elastic band of the surgical cap.

With reference to FIGS. 3 and 4, the surgical cap 10 is shown removed from the user 12. The side wall 16 has a lower end 20 with an edge 40 extending around an opening 42 of the surgical cap 10 which receives a head 13 of the user 12. The opening 42 opens into a head-receiving cavity 44 of the surgical cap 10. The surgical cap 10 includes a flexible portion 22 that stretches to accommodate varying head sizes. The flexible portion 22 extends around less than the entire circumference of the opening 42 in the illustrated embodiment, although in alternative embodiments the flexible portion can be disposed around the entire circumference or to a greater or lesser extent than shown.

The flexible portion 22 includes layers 24 of the side wall 16 that extend along a flexible, resilient member, such as a piece of elastic 26. The elastic 26 is sewn or otherwise secured to the side wall 16 and is stretched when the surgical cap 10 is placed on the head 13 of the user 12. The tensioned elastic 26 holds the surgical cap 10 in position on the head 13 of the user 12. As discussed below, the elastic 26 is covered by the material of the side wall 16, so that the elastic 26 generally does not irritate or leave a mark on the skin of the user 12.

The surgical cap 10 has a front 30, which extends over the front of the head 13 of the user 12 and a back 32 that extends over the back of the head 13 of the user 12. To provide additional clearance for hair or the neck of the user 12, the surgical cap 10 includes a recess 34.

With reference to FIG. 4, the layers 24 have a gathered configuration and smooth out as the flexible portion 22 is stretched. The elastic 26 is sewn to or otherwise secured to one or more of the layers 24 so that the elastic 26 elongates as the flexible portion 22 is stretched. When the flexible portion 22 and the elastic 26 thereof extend along less than the entire circumference of the opening 42, less elastic material may be used.

Figure 5:
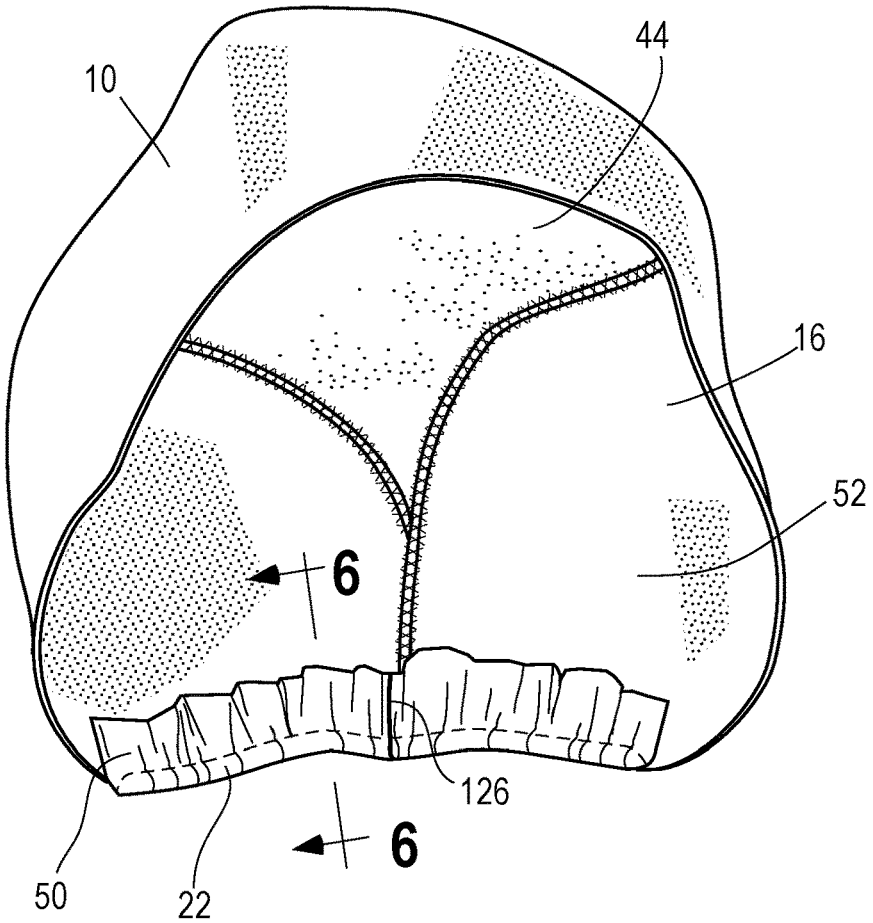
FIG. 5 is a perspective view of an interior of the surgical cap of FIG. 1.

The interior of the head-receiving cavity 44 is shown in FIG. 5. The layers 24 include a layer 50 inward from the elastic 26 that separates the elastic 26 from the head 13 of the user 12. The layer 50 may extend upward beyond the elastic 26 and along an inner surface 52 of the side wall 16.

Figure 6:
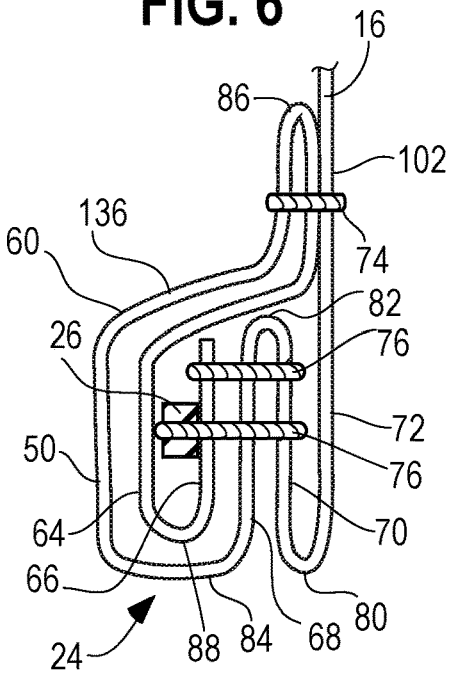
FIG. 6 is a cross-sectional view of a flexible portion of the surgical cap taken across line 6-6 in FIG. 5.

With reference to FIG. 6, a cross-sectional view is provided of the side wall 16, the layers 24 of the side wall 16, and the elastic 26. As discussed in greater detail below, the side wall 16 includes panels 60, 62 which are folded to form folds 80 (first fold), 82 (second fold), 84 (third fold), 86 (fourth fold), 88 (fifth fold) which provides the layers 24 that cover the elastic 26 and provide a substrate for supporting the elastic 26.

In one form, the layers 24 include at least one layer, such as a pair of layers 50, 64, inward from the elastic 26 (to the left in FIG. 6) for covering the elastic 26, and limiting irritation to the skin of the user 12. The layers 50 and 64 thus comprise a first and a second inner layer. The layers 24 further include at least two layers, such as layers 66, 68, 70, 72 outward from the elastic 26 (to the right in FIG. 6) that provide a stronger section of the side wall 16 for securing the elastic 26. The layers 66, 68, 70 and 72 may be considered a first, a second, a third, and a fourth outer layer. In one approach, the elastic 26 is sewn onto the layers 66, 68, 70 with thread 76 using a loop stitch technique, which also secures the layers 66, 68, 70 together. The layers 50, 64 may be sewn with thread 74 to a body 102 of the side wall 16 that includes the layer 72. This keeps the layers 50, 64 secured relative to the layers 66, 68, 70, 72.

In one form, the layers 50 (first inner layer), 64 (second inner layer), 66 (fourth outer layer), 68 (first outer layer), 70 (second outer layer), 72 (third outer layer) are made from one piece of material and, as another example, the side wall 16 including the layers 50, 64, 66, 68, 70, 72 may be made from one piece of material. The layers 50, 64, 66, 68, 70, 72 may be held in position using a number of approaches including sewing and/or adhesive. In other approaches, the layers 50, 64, 66, 68, 70, 72 may be made from a plurality of pieces of material that are secured together. For example, a first piece of folded-over material including the layers 50, 64 may be sewn over the elastic 26 and secured to a second piece of folded-over material including the layers 66, 68, 70, 72. As another example, the body 102 of the side wall 16 may be made from a first piece of material and the elastic 26 is sewn to body 102. A second piece of material folded to have a v-shape and is used to cover the elastic 26. More specifically, the second piece of material is positioned so that one half of the v-shape is disposed on one side of the elastic 26 and the other half of the v-shape is disposed on the opposite side of the elastic 26.

The top 14 and the side wall 16 may be made from one or more materials including propylene, rayon, paper, polyester mesh (scrim), and other synthetic or natural woven or non-woven materials, and combinations thereof. The thread 74, 76 may be made from polyester.

Figure 7:
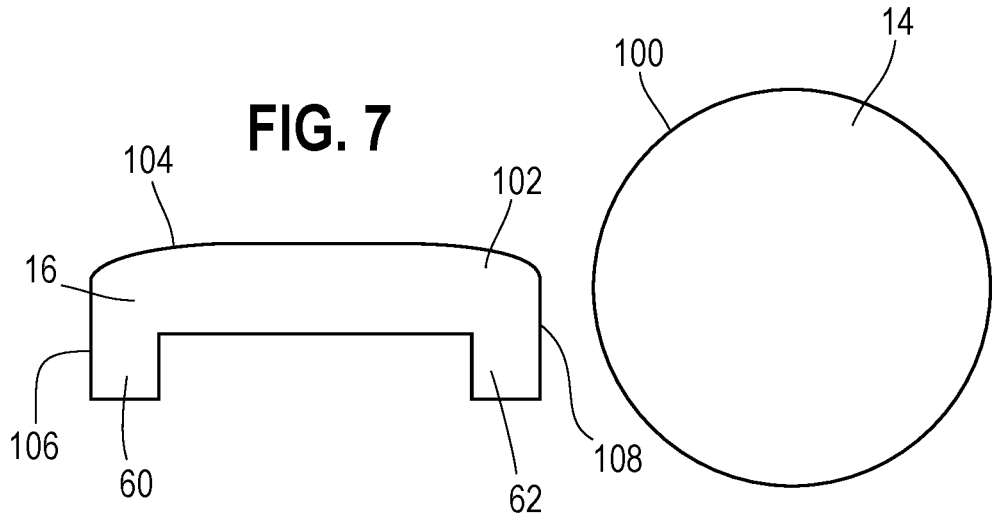
FIG. 7 is a schematic view of a top and a side wall used to fabricate the surgical cap of FIG. 1.

Turning to FIGS. 7-19, various steps in a method of fabricating the surgical cap 10 are depicted. The method includes providing the top 14 and the side wall 16 as shown in FIG. 7. The top 14 and side wall 16 may be provided as blanks in the form of the top 14 and side wall 16 which have been cut from respective rolls of material. The top 14 may have a shape selected to conform the surgical cap 10 to a variety of head shapes and sizes and has an outer edge 100. For example, the top 14 may have a teardrop shape, an elliptical shape, or a circular shape as depicted.

The side wall 16 has a shape selected to allow the surgical cap 10 to receive and conform to a variety of head shapes and sizes. The side wall 16 includes the body 102 and the panels 60, 62 depending from the body 102. The side wall 16 has an upper edge 104 and longitudinal edges 106, 108 extending downwardly from the upper edge 104.

Figure 8:
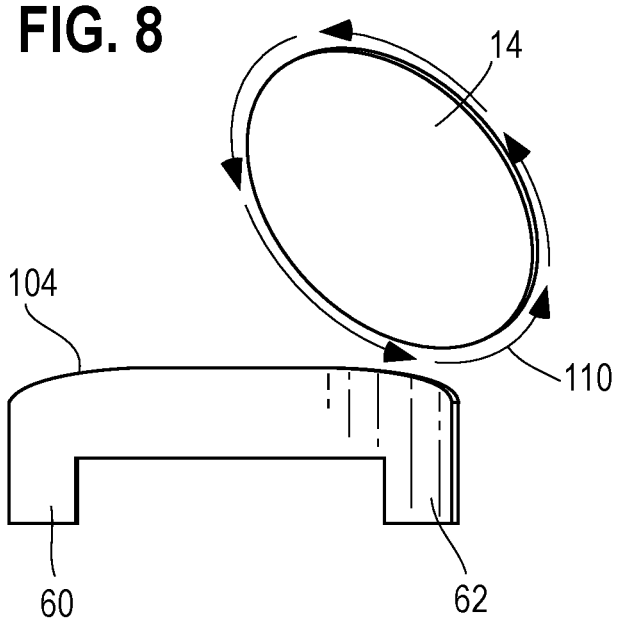
FIG. 8 is a representational view of the top being sewn to the side wall during fabrication of the surgical cap.

With reference to FIG. 8, the method includes attaching the top 14 to the side wall 16. In one approach, the edge 100 of the top 14 is sewn to the upper edge 104 of the side wall 16. Because the top 14 is circular, sewing the edges 100, 104 together involves curving the side wall 16 from a flat configuration to a generally annular configuration.

Figure 9:
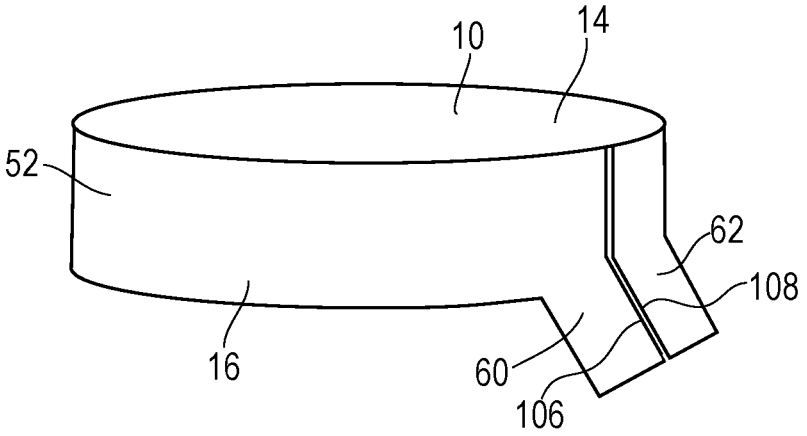
FIG. 9 is a perspective view of the surgical cap after the top has been sewn to the side wall showing the cap inside-out and panels of the side wall abutting.

The surgical cap 10 is shown in FIG. 9 after the top 14 has been sewn to the side wall 16. At this point, the surgical cap 10 has an inside-out configuration with the inner surface 52 of the side wall 16 being visible in FIG. 9. Once the top 14 has been sewn to the side wall 16, the edges 106, 108 of the panels 60, 62 are positioned adjacent each other.

Figure 10:
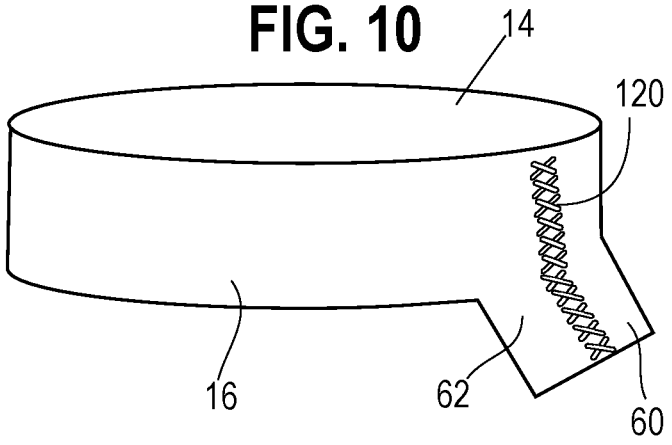
FIG. 10 is a perspective view similar to FIG. 9 showing the panels sewn together.

As shown in FIG. 10, the method includes joining the panels 60, 62 together such as by sewing the edges 106, 108 together with thread 120.

Figure 11:
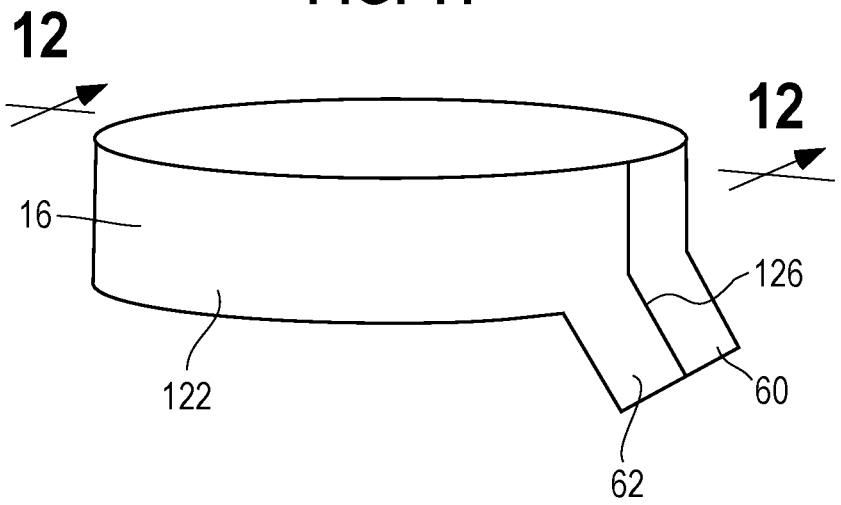
FIG. 11 is a schematic view similar to FIG. 9 showing the surgical cap right-side-out and a seam between the panels.
Figure 12:
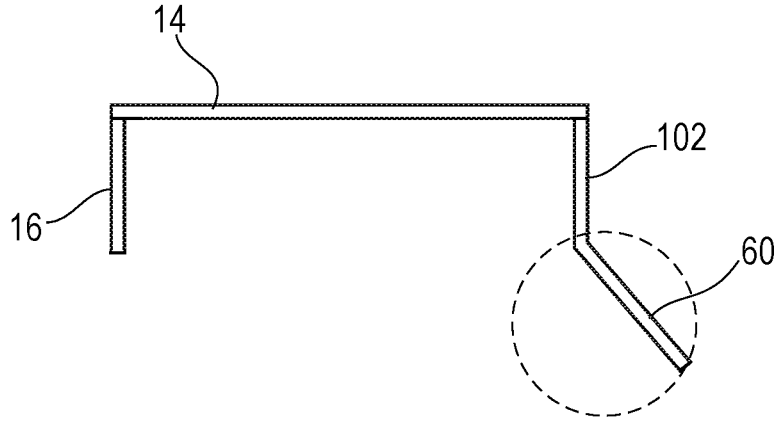
FIG. 12 is a cross-sectional view taken across line 12-12 in FIG. 11 showing one of the panels of the side wall depending from a body of the side wall.

With reference to FIG. 11, the surgical cap 10 has been reversed to a right-side-out configuration wherein an outer surface 122 of the side wall 16 is visible. In FIG. 10, the edges 106, 108 of the panels 60, 62 have been sewn together with thread 120 to form a seam 126 therebetween. The panels 60, 62 are secured together and depend from the body 102 of the side wall 16 as shown in FIG. 12.

With reference to FIGS. 13-19, the method includes folding the panels 60, 62 to form the plurality of layers 24 which operate as a cover and a substrate for the elastic 26 and results in the configuration of the flexible portion 22 shown in FIG. 6. The following discussion of FIGS. 13-19 refers to panel 60, although similar operations are concurrently performed on the panel 62 which has been joined to the panel 60. Thus, the layers 50, 64, 66, 68, 70, 72 are formed in both panels 60, 62.

Figure 13:
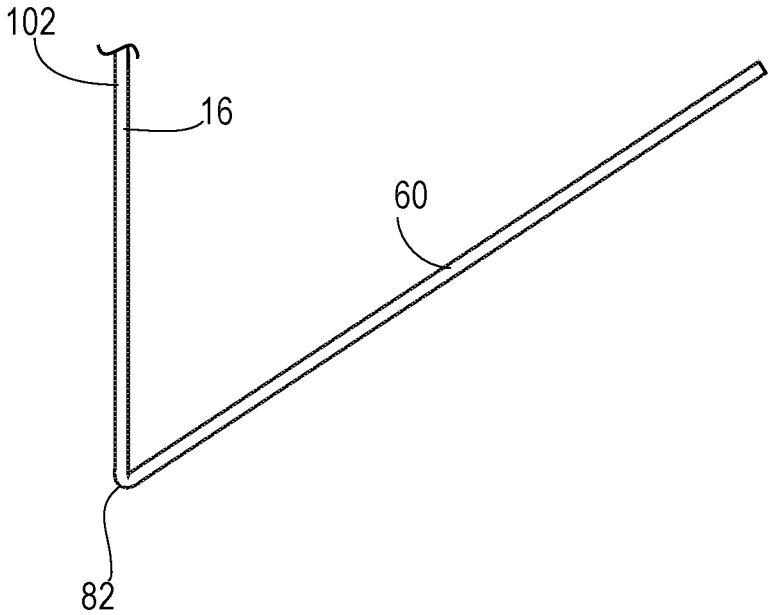
FIG. 13 is an enlarged view of the area shown in the dashed circle of FIG. 12 showing the panel having been folded outwardly.
Figure 14:
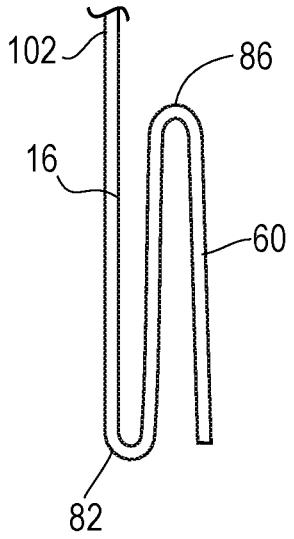
FIG. 14 is a view similar to FIG. 13 showing the panel having been folded to form a bend in the panel.
Figure 15:
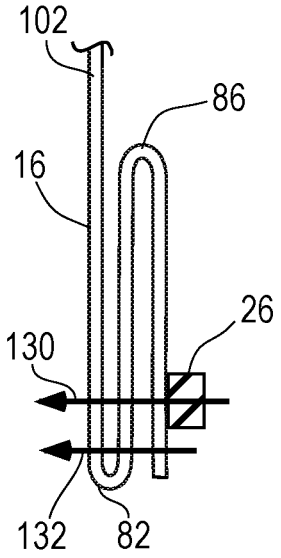
FIG. 15 is a view similar to FIG. 14 showing elastic positioned against the folded panel.

With reference to FIGS. 13 and 14, the panel 60 is manipulated to form folds 82, 86. The elastic 26 is positioned against and secured to the folded panel 60 by sewing 130, 132 as shown in FIG. 15. In another approach, the elastic 26 may be secured to the folded panel 60 by stapling, adhesive, or other approaches.

Figure 16:
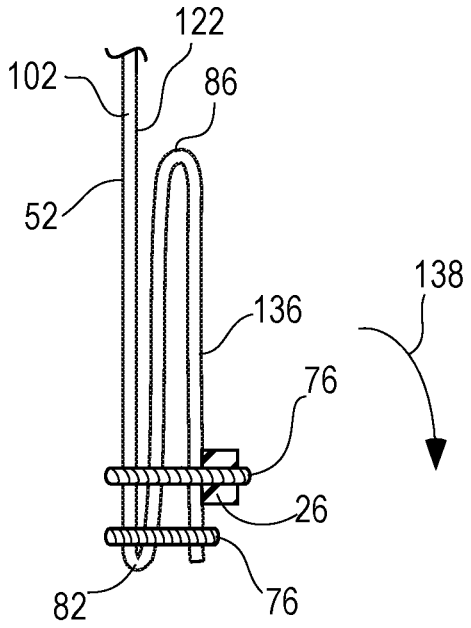
FIG. 16 is a view similar to FIG. 15 showing the elastic sewn to the folded panel.
Figure 17:
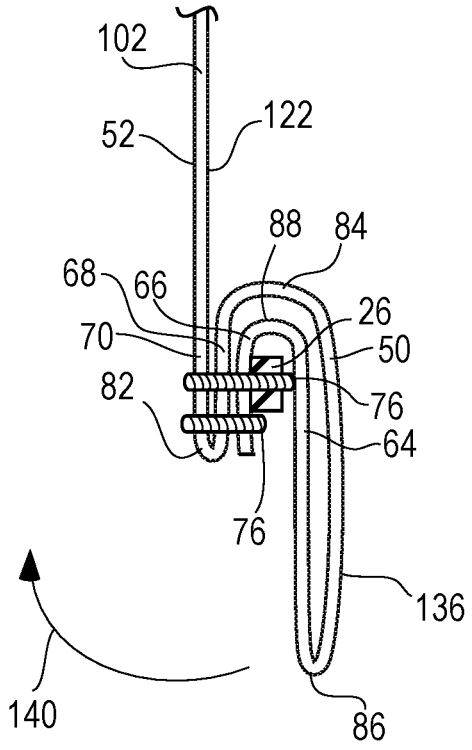
FIG. 17 is a view similar to FIG. 16 showing the bend moved downwardly such that there are three layers of panel material on one side of the elastic and two layers of panel material on the opposite side of the elastic.

With reference to FIG. 16, the elastic 26 has been secured to the folded panel 60 by thread 76. The method further includes folding a cover portion 136 of the panel 60 generally downward in direction 138 to re-position the fold 86 from a position above the elastic 26 to a position below the elastic 26 (as shown in FIG. 17). This positions the elastic 26 between layers 66, 68, 70 on one side of the elastic 26 and layers 50, 64 on an opposite side of the elastic 26.

Figure 18:
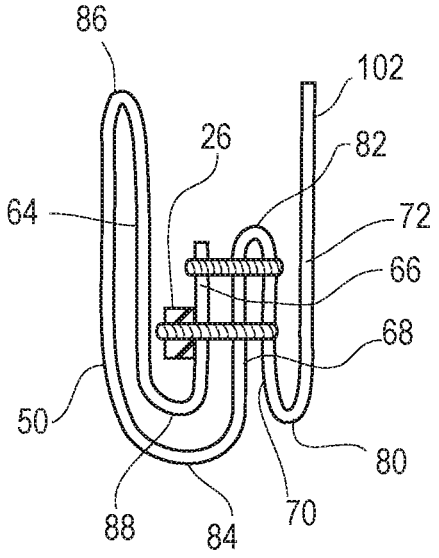
FIG. 18 is a view similar to FIG. 17 showing the layers and the elastic pivoted inwardly so that the bend in the panel is at an upward position inward from the body of the side wall of the cap.

As shown in FIGS. 17 and 18, the cover portion 136 is next pivoted inwardly in direction 140. This repositions the layers 50, 64, 66, 68, 70 and elastic 26 from a position outside of the surgical cap 10 to a position inside the surgical cap 10. Further, the repositioning forms the fold 80.

Figure 19:
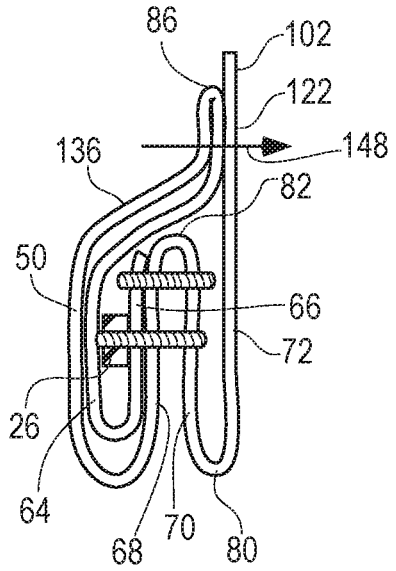
FIG. 19 is a view similar to FIG. 18 showing the bend being sewn to the body of the side wall.

Turning to FIG. 19, the cover portion 136 is secured to the body 102 of the side wall 16 by sewing 148. In this manner, the elastic 26 is sandwiched between layers 50, 64 inward from the elastic 26 and the layers 66, 68, 70, 72 outward from the elastic 26.

Returning to FIG. 6, the cover portion 136 has been secured to the body 102 of the side wall 16 with the thread 74 after the sewing 148 shown in FIG. 19. The layers 50, 64 may thereby separate the elastic 26 from the head 13 when the head 13 is positioned in the head-receiving cavity 44. Additionally, the layers 66, 68, 70, and 72 provide a strong substrate to which the elastic 26 may be secured. In this way, the material of side wall 16 may be relatively thin to minimize cost and weight while providing sufficient strength to support the elastic 26 and protect the skin of the user 12 from the elastic 26. In one form, the layers 50, 64, 66, 68, 70, and 72 are all formed from one piece of material from which the side wall 16 is made, i.e., the blank of the side wall 16 shown in FIG. 6.

Uses of singular terms such as "a," "an," are intended to cover both the singular and the plural, unless otherwise indicated herein or clearly contradicted by context. The terms "comprising," "having," "including," and "containing" are to be construed as open-ended terms. Any description of certain embodiments as "preferred" embodiments, and other recitation of embodiments, features, or ranges as being preferred, or suggestion that such are preferred, is not deemed to be limiting. The invention is deemed to encompass embodiments that are presently deemed to be less preferred and that may be described herein as such. All methods described herein can be performed in any suitable order unless otherwise indicated herein or otherwise clearly contradicted by context. The use of any and all examples, or exemplary language (e.g., "such as") provided herein, is intended to illuminate the invention and does not pose a limitation on the scope of the invention. Any statement herein as to the nature or benefits of the invention or of the preferred embodiments is not intended to be limiting. This invention includes all modifications and equivalents of the subject matter recited herein as permitted by applicable law. Moreover, any combination of the above-described elements in all possible variations thereof is encompassed by the invention unless otherwise indicated herein or otherwise clearly contradicted by context. No unclaimed language should be deemed to limit the invention in scope. Any statements or suggestions herein that certain features constitute a component of the claimed invention are not intended to be limiting unless reflected in the appended claims. Neither the marking of the patent number on any product nor the identification of the patent number in connection with any service should be deemed a representation that all embodiments described herein are incorporated into such product or service.

What is claimed is:

1. A surgical cap comprising:

a cover having a head-receiving cavity;

a resilient member connected to the cover and extending around less than the perimeter of the entire head-receiving cavity; and a plurality of layers of the cover including exactly two inner layers inward from the resilient member adapted to separate the resilient member from a head received in the head-receiving cavity and four outer layers outward from the resilient member, the resilient member being secured to at least one of the four outer layers, the inward and outward direction defined with respect to the head-receiving cavity;

wherein the exactly two inner layers and the four outer layers are made from a single piece of material.

2. The surgical cap of claim 1 wherein a fold connects the exactly two inner layers and the four outer layers.

3. The surgical cap of claim 1 wherein the cover includes a top and a side wall depending from the top.

4. The surgical cap of claim 3 wherein the top and the side wall are made of different materials.

5. The surgical cap of claim 3 wherein the side wall has a one-piece construction and the exactly two inner layers and the four outer layers are portions of the side wall.

6. The surgical cap of claim 1 wherein the exactly two inner layers and the four outer layers are secured to sandwich the resilient member between the pair of inner layers and the four outer layers.

7. The surgical cap of claim 1, the cover further comprising a top portion coupled to a sidewall portion, the sidewall portion being formed of a single piece of material, and the exactly two inner layers and the four outer layers being formed from the same single piece of material.

8. The surgical cap of claim 7, wherein the exactly two inner layers is directly coupled to the sidewall portion above a fold joining one of the exactly two inner layers to one of the four outer layers.

9. The surgical cap of claim 1, comprising exactly four outer layers.

10. The surgical cap of claim 9, the resilient member being secured to three of the four outer layers.

11. A cap comprising:

a cover having a head-receiving cavity, the cover comprising a top portion and a wall portion;

the wall portion comprising plural layers formed from a single piece of material, the layers comprising:

a first outer layer that comprises a portion of said wall portion;

a second outer layer that is connected to said first outer layer at a first fold;

a third outer layer that is connected to said second outer layer at a second fold;

a first inner layer that is connected to said third outer layer at a third fold;

a second inner layer that is connected to said first inner layer at a fourth fold, the cap comprising exactly two inner layers; and a fourth outer layer that is connected to said second inner layer at a fifth fold;

the cap including a resilient member extending around less than the entire perimeter of the head-receiving cavity and disposed within said fifth fold, the first and second inner layers separating the head-receiving cavity from the resilient member, the first and second inner layers being disposed inwardly relative to the resilient member, and the first, second, third, and fourth outer layers being disposed outwardly relative to the resilient member, and the inward and outward direction defined with respect to the head receiving cavity.

12. The cap of claim 11, comprising a stitched connection between the second outer layer, the third outer layer, and the fourth outer layer.

13. The cap of claim 11, comprising a stitched connection between the second outer layer, the third outer layer, the fourth outer layer, and the resilient member.

14. The cap of claim 11, comprising a stitched connection between the first inner layer, the second inner layer, and the wall portion.

15. The cap of claim 11, comprising a stitched connection between the second outer layer, the third outer layer, and the fourth outer layer;

a stitched connection between the second outer layer, the third outer layer, the fourth outer layer, and the resilient member; and a stitched connection between the first inner layer, the second inner layer, and the wall portion.

16. The surgical cap of claim 11, comprising exactly four outer layers.

* * * * *